US006346132B1

(12) United States Patent
Huber et al.

(10) Patent No.: US 6,346,132 B1
(45) Date of Patent: Feb. 12, 2002

(54) HIGH-STRENGTH, HIGH-DAMPING METAL MATERIAL AND METHOD OF MAKING THE SAME

(75) Inventors: Ulrike Huber, Munich; Rainer Rauh, Jetzendorf; Eduard Arzt, Stuttgart, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/595,359

(22) Filed: Jun. 15, 2000

Related U.S. Application Data

(63) Continuation-in-part of application No. 09/154,384, filed on Sep. 16, 1998.

(30) Foreign Application Priority Data

Sep. 18, 1997 (DE) ..... 197 41 019

(51) Int. Cl.[7] ..... B22F 1/02; B22F 3/00

(52) U.S. Cl. ..... 75/229; 75/249; 419/30; 419/35; 419/49

(58) Field of Search ..... 75/229, 249; 419/30, 419/35, 49

(56) References Cited

U.S. PATENT DOCUMENTS

| | | | |
|---|---|---|---|
| 4,015,947 | A | 4/1977 | Daver |
| 4,236,925 | A | 12/1980 | Onuki et al. |
| 4,282,033 | A | 8/1981 | Goldstein et al. |
| 4,491,558 | A | 1/1985 | Gardner |
| 4,684,414 | A | 8/1987 | Masumoto et al. |
| 4,750,953 | A | 6/1988 | Tabei |
| 4,759,906 | A | 7/1988 | Nenno et al. |
| 4,946,647 | A | 8/1990 | Rohatgi et al. |
| 5,028,392 | A | 7/1991 | Lloyd et al. |
| 5,228,494 | A | 7/1993 | Rohatgi |
| 5,508,116 | A | 4/1996 | Barrett |

FOREIGN PATENT DOCUMENTS

| | | |
|---|---|---|
| DE | 3740424 | 6/1989 |
| DE | 3843859 | 6/1990 |
| EP | 0334505 | 9/1989 |
| EP | 0568705 | 11/1993 |
| GB | 730164 | 5/1955 |
| GB | 805100 | 11/1958 |
| GB | 2043103 | 10/1980 |
| WO | WO 95/19861 | 7/1995 |

OTHER PUBLICATIONS

German Industrial Standard, Alunminum and Aluminum alloys, DIN EN 573–3, Dec. 1994, Table 6: Aluminium Alloys—series 6000—AlMgSi.

In Shup Ahn et al.; "Fabrication of Mechanically Alloyed TiNiCu Powders and Damping Properties of Al/TiNiCu Sintered Materials"; Metals and Materials, vol. 3, No. 4, (1997) pp. 260–264, published Dec. 15, 1997.

Sung–Yeal Bae et al; "Damping Properties of Al/NiTi Sintered Materials Using the NiTi Powders Fabricated by Mechanical Alloying"; with English Abstract; J. of Korean Inst. of Met. & Mater., vol. 35, No. 10, pp. 1375–1379; published Oct. 14, 1997.

*Primary Examiner*—Ngoclan Mai
(74) *Attorney, Agent, or Firm*—W. F. Fasse; W. G. Fasse

(57) ABSTRACT

A composite material includes a metallic second phase dispersed in a metallic matrix material. The metallic second phase has a grain structure that is at least partially martensitic. The second phase material is preferably an alloy of nickel and titanium, each present in the range from 48 to 52 atomic %, optionally in combination with further additives. The second phase particles can be present in the form of granular particles, wires, fibers, whiskers, or layers, making up 5 to 60 vol. % of the overall composite material. The matrix material is preferably an aluminum alloy. The composite material has a high damping capacity and a high tensile strength provided by the matrix, and a high damping capacity provided by the second phase. A method of making the composite material involves mixing a powdery matrix material and a powdery second phase material, and then heat and consolidating the mixture at a temperature of 400 to 700 ° C. and a pressure of 100 to 300 MPa.

44 Claims, No Drawings

HIGH-STRENGTH, HIGH-DAMPING METAL MATERIAL AND METHOD OF MAKING THE SAME

CROSS-REFERENCE TO RELATED APPLICATION

This application is a Continuation-in-part of our copending U.S. application Ser. No. 09/154,384 filed on Sep. 16, 1998.

PRIORITY CLAIM

This application is based on and claims the priority under 35 U.S.C. §119 of German Patent Application 197 41 019.7, filed on Sep. 18, 1997, of which the entire disclosure is incorporated herein by reference.

FIELD OF THE INVENTION

The invention relates to a structural material, and particularly a metal based composite material, having a high damping capacity and a high tensile strength, comprising an essentially metallic base material or matrix and a second phase in the matrix. The invention further relates to a method of making such a material and to rigid structural parts made of such a material.

BACKGROUND INFORMATION

In various fields of industry, the presently typical high accelerations of mechanically moving parts cause undesirable vibrations in those parts over a wide frequency spectrum. The high vibration loading in the vibrating systems leads to long dead or idle times, for example due to long run-up transient processes, and also limits the operating lifetime of the vibrationally loaded parts. Another significant problem is the noise generated by the vibrations.

In order to overcome or avoid these problems of vibrations, it is generally known to use materials having a high damping capacity to damp out the vibrations as much and as quickly as possible. However, present structural materials do not possess a sufficient damping capacity in and of themselves, and present damping materials do not possess a sufficient strength to perform as structural materials themselves.

Metals and metal alloys are predominantly used as structural materials in a broad field of applications, due to their high strength, low weight or density, and good corrosion resistance. However, such metals and metal alloys typically have a rather low damping capacity, so that it becomes necessary to use additional damping materials purely for the purpose of achieving the desired damping in structures comprising metal and metal alloy structural parts. Such damping materials are generally synthetic polymers or plastics, but such materials suffer limitations in their applicability for example in applications at temperatures above the respective melting points of the materials or in situations of limited space. Gray cast iron and pure magnesium are characterized by a higher damping capacity, but on the other hand these materials possess a rather limited strength.

U.S. Pat. No. 4,946,647 (Rohatgi et al.) discloses metallic composite materials of an aluminum matrix with graphite particles dispersed therein as a second phase, as well as a method for making the same. While the known composite materials are said to have an improved damping capacity relative to aluminum or aluminum alloys per se, the disclosed composites have a significantly reduced strength compared to aluminum or aluminum alloys per se.

Particularly, the disclosed materials have a tensile strength of at most 190 MPa, which is far below that of the matrix, and an elongation of at most 4%, even when pure aluminum is used as the matrix material. These mechanical properties demonstrate that the disclosed composite materials achieve the desired damping characteristics only at the expense of a drastic reduction in strength, and the materials are thus not suitable for use as structural materials. The reference even admits this deficiency in the strength, and suggests that the graphite content must be controlled or limited to achieve the required strength values. Of course, such limitations on the graphite content will in turn reduce the desired damping characteristics.

U.S. Pat. No. 4,236,925 (Onuki et al.) discloses a method of producing a sintered material having an increased damping capacity and comprising a second phase of graphite, lead or magnesium. The disclosed method includes steps of mixing the second phase material in powder form with the remainder of a powdery iron, copper, or aluminum metal, compression-molding the mixture, sealing or canning the compression-molded mixture in a deformable vessel, subjecting the vessel and the mixture therein to a plastic deformation treatment, and then sintering the plastically deformed vessel and mixture therein. The heating temperature in the sintering step must be above the recrystallization temperature of the matrix metal, so that the matrix metal becomes recrystallized, and the second phase material is aggregated in the form of spindles on the crystal surface or in the crystals of the matrix metal. These steps are complicated and costly, and the method necessarily limits the second phase material to have a spindle shape.

SUMMARY OF THE INVENTION

In view of the above, it is an object of the present invention to provide a material that comprises an essentially metallic base material or matrix and a second phase in the matrix, which has both an increased damping capacity already at low vibration amplitudes, as well as a sufficiently high tensile strength and elongation so that it may be used as a structural material particularly for rigid, form-stable structural parts. A further object of the invention is to provide a method for producing a material having a high damping capacity and a high strength, without requiring additional complicated method steps such as high temperature sintering or the like, and without limitation of the form of the second phase material. The invention further aims to avoid or overcome the additional disadvantages of the prior art, and to achieve additional advantages, as apparent from the present description.

The above objects have been achieved in a metallic material according to the invention, having a high damping capacity and a high tensile strength, comprising a metallic base material or matrix and a second phase in the matrix, wherein the second phase is metallic and at least partially comprises a martensitic grain structure. It has been discovered that the inventive combination of a metallic second phase at least partially comprising a martensitic grain structure in a metallic matrix achieves high damping characteristics, even at low vibration amplitudes. A further advantage is that the partially martensitic second phase does not negatively influence the mechanical properties of the matrix, so that the overall material maintains its strength characteristics and therefore can be used as a structural material in the same manner and the same applications as the matrix material could be used by itself.

It is further significant that the inventive material does not place any particular limitations on the selection of the outer shape, form or configuration of the second phase. Namely, the second phase can be in the form of granular or globular particles fibers, strands, whiskers, wires, or the like. By appropriately selecting the form of the second phase, it is possible in a simple manner to adapt the respective characteristics of the overall material to the requirements at hand in any particular application. It should be noted that the second phase is preferably dispersed throughout the matrix in an unmixed and un-alloyed condition relative to the matrix, such that distinct particles of the second phase remain embedded in the matrix, thus providing an overall composite structure for the inventive material. In other words, the overall material according to the invention is especially not a homogenous alloy, but rather a composite of un-mixed materials.

Preferably, the second phase itself is an alloy. An advantageous material damping capacity can be achieved if an alloy of nickel and titanium is used as the second phase, and particularly when each of these alloying components is present and intermixed in the range of 48 to 52 atom %. The most preferred alloy composition of nickel and titanium for the second phase is 49.9 atomic % nickel, and 50.1 atomic % titanium. These components and compositions of the alloy are only preferred values, and are not necessary limitations on the broadest scope of the invention.

The material damping capacity can be even further increased if the second phase includes additives in a positive amount up to 25 atomic %, for stabilizing the martensitic phase and for adapting the material properties to the operating requirements in a particular application. Both the number of additives as well as the compositional content limits thereof are not absolute limitations on the broadest scope of the invention, but represent preferred values. The additives may advantageously be selected from among zirconium, hafnium, copper, niobium, manganese, palladium, platinum and iron. Stabilization of the martensitic phase can be further reinforced by a pretreatment of the second phase material, for example by plastically deforming the second phase or carrying out a homogenizing treatment of the alloy components of the second phase.

As mentioned above, the second phase can be in the form of granular or globular particles, grains, short fibers, long fibers, whiskers, spheroids, or the like. Throughout this disclosure, the general term "particles" will be used to cover all different configurations or forms of the particles, grains, fibers, etc., unless the particle shape is particularly specified. The second phase particles can be uniformly dispersed throughout the matrix, or may be present or concentrated in one or more layers extending through the matrix material. Particles having an anisotropic shape, such as fibers or whiskers, may be randomly oriented or oriented in a uniform direction. By properly selecting the particle form, dispersion pattern through the matrix, and particle orientation, the overall properties of the resulting composite material can be maximally adapted to the externally specified requirements.

This can further be achieved in that the proportional content of the second phase in the total material is varied or selected, preferably in the range from 5 to 60 vol. %, depending on the desired overall properties of the material. A higher proportion of the second phase will generally achieve a higher damping capacity. Therefore, in applications where damping is particularly important, the invention provides for greater than 30 vol. % and particularly greater than 35 vol. % of the second phase. Once again, these ranges are preferred proportional ranges providing improved characteristics, but are not strict limitations on the broadest scope of the invention.

In order to improve the bonding of the second phase with the matrix material, and thereby to better ensure the necessary load transfer from the matrix material to the second phase for achieving the desired damping, it is advantageous if an outer boundary layer of each particle of the second phase material forms a compound or a mixed phase with the matrix material. Such a structure can be achieved by carrying out the method according to the invention as discussed below.

By providing a metallic second phase that has an at least partially martensitic grain structure within the matrix material, it is possible to achieve the required damping characteristics of the overall composite material by the function or action of the second phase by itself, while the tensile strength and elongation of the overall material are predominantly provided or determined by the matrix. Namely, the overall composite material preferably has a minimum tensile strength and minimum elongation of 10%, or preferably only 5%, below the corresponding values of the matrix material by itself. More preferably, the tensile strength and elongation of the overall composite are equal to or even better than those of the matrix material by itself. For this reason, the matrix material can be selected accordingly to achieve all requirements as a structural material in different applications, while the second phase can be selected to achieve the desired damping characteristics. The overall composite material has a damping capacity of greater than $1\times10^{-3}$ and an elongation greater than 1%. The damping capacity of the overall composite material is preferably at least 10 times that of the matrix material by itself.

In view of the mechanical properties, the base material is advantageously a light metal or a light metal alloy, such as aluminum, aluminum alloys, titanium, titanium alloys, or magnesium alloys for example, and excluding iron-based alloys. In this context, it is particularly preferred to use the aluminum alloy designated as EN AW-6061 according to the German Industrial Standard DIN EN 573, which has the following composition: 0.40 to 0.8 wt. % of silicon, up to 0.7 wt. % of iron, 0.15 to 0.40 wt. % of copper, up to 0.15 wt. % of manganese, 0.8 to 1.2 wt. % of magnesium, 0.04 to 0.35 wt. % of chromium, up to 0.25 wt. % of zinc, up to 0.15 wt. % of titanium, up to 0.15 wt. % total of other additives, and the remainder of aluminum. As an example, a sample having 90 vol. % of a matrix of aluminum EN AW-6061 and 10 vol. % of a second phase of $Ni_{49.9}Ti_{50.1}$ achieves a tensile strength of 223 MPa, a damping capacity of $5\times10^{-3}$ and an elongation of more than 10%. However, applications that require an even higher strength may exist or arise, in which case it is possible to use a matrix material that has different or various grain structures or that is a composite material in itself including a matrix and a third phase dispersed in the matrix for reinforcement. A thermomechanical treatment properly adapted for the particular matrix material can similarly lead to an advantageous increase of the strength of the matrix material.

The above objects have further been achieved by a method of making a material having high damping capacity and high strength, according to the invention, comprising steps of mixing a powdery matrix material and a powdery second phase material, and then heat treating the mixture in a temperature range from 400 to 700° C. and consolidating the same at a pressure of 100 to 300 MPa. In this context, the holding time can be between one hour and six hours. However, carrying out the consolidation at 540° C. and 200 MPa for a two hour holding time has been shown to achieve the best results.

With regard to the selection of the characteristics of the starting or initial states of the matrix material and of the second phase, the best results have been obtained when the matrix material is in the form of a particulate or powder material that has been rapidly solidified by atomizing it into an inert gas environment. Insofar as the selected outer configuration of the second phase particles allows it, the second phase material is also provided in the form of particles that have been processed in this manner. An advantageous additional method step involves de-gassing the mixture of matrix material and second phase material before carrying out the consolidation. The consolidation itself can be carried out by means of hot isostatic pressing, sintering, extrusion pressing, or forging.

As a further variation of the method according to the invention, the matrix material may first be melted, and the second phase material may then be mixed into the molten matrix material. In this case, it is advantageous to protect the second phase particles in order to prevent an excessive reaction between the two materials when the second phase particles are mixed into the molten matrix material. This can be achieved by providing a coating on the outside surface of the respective second phase particles before introducing the particles into the molten matrix material.

In both variants of the inventive manufacturing method, i.e. either using a powdery matrix material or using a molten matrix material as a starting point, the second phase particles can be provided in various external configurations. Advantageously, the second phase is provided in the form of globular or granular particles, wires, short fibers, or one or more layers. In a further preferred step, the second phase is pre-treated in order to stabilize the martensitic phase before carrying out the consolidation. This martensite stabilizing treatment can involve deforming the second phase material, or homogenizing the components of the second phase therein.

The methods for manufacturing the material according to the invention do not necessarily include any critical method steps in which the second phase material must be brought into a particular external form or configuration. Moreover, the present methods do not require an additional step of heating the material to a temperature above the recrystallization point of the matrix material in order to achieve a high damping capacity.

DETAILED DESCRIPTION OF A PREFERRED EXAMPLE EMBODIMENT OF THE INVENTION

An example embodiment of the method for producing a material according to the invention was carried out as follows. An aluminum alloy material designated as EN AW-6061 according to the German Industrial Standard DIN EN 573 was atomized into an argon environment to form a corresponding aluminum alloy powder having a particle size smaller than 45 $\mu$m. A nickel-titanium powder having a particle size smaller than 180 $\mu$m and a composition of 49.9 atomic % nickel and 50.1 atomic % titanium was formed in a similar manner, i.e. by atomization into an argon atmosphere. The two powders were mixed together to provide a mixture containing 10 vol. % of Ni—Ti powder and 90 vol. % of Al alloy powder. The powder mixture was filled into capsules, whereby the mixture was degassed at room temperature and then the capsules were sealed in a gas-tight manner to avoid the formation of gas-filled pores. The consolidation of the material was then carried out by hot isostatic pressing for two hours at a pressure 200 MPa and a temperature of 540° C.

The resulting composite material produced in the above manner was examined, to find that the Ni—Ti particles were homogeneously dispersed and distributed throughout the Al alloy matrix. The tensile strength of the composite material corresponds to that of the A1 alloy EN AW-6061 itself, manufactured by hot isostatic pressing. Furthermore, the resulting composite material comprises an elongation of greater than 10%. With these properties, it is apparent that the composite material is suitable for use as a structural material in all the same applications as the matrix alloy would have been useful by itself.

Another recommended alloy composition of the second phase particles is 60 atomic % copper, 21 atomic % zinc, and 19 atomic % aluminum, having a martensitic grain structure. This second phase alloy can be substituted for the Ni—Ti alloy described above, according to the same method for forming an advantageous composite material. It is expected that substantially any metallic second phase material having a martensitic grain structure and being compatible with the respective selected matrix material would be suitable and would achieve the desired improvement in the damping capacity.

Generally, the present structural material can be used to fabricate any structural part, i.e. any load-bearing component of a machine, mechanism or any other mechanical structure or device, and especially such structural parts that are subjected to vibration due to the motion or operation of the machine or other structure. Due to the excellent strength, rigidity, elongation and other mechanical properties, the present structural material makes excellent load-carrying rigid structural parts, and due to the excellent damping characteristics, such rigid structural parts simultaneously serve as vibration dampers. These properties make the present structural material especially well-suited for use in motor vehicles (e.g. for combustion engine parts such as oil pans, cylinder heads, spark plug covers, crankcase housing, crankcase parts and vacuum modules, chassis and frame parts, body parts, transmission and gear case housings, mounting brackets, etc.), in aircraft (e.g. structural parts of fuselage and wings, engine mount structures, actuator mount structures, landing gear, etc.), in railroad cars (chassis parts, bogie structures, wagon compartment structures, etc.) and in spacecraft (e.g. payload racks and supports). The rigid structural parts according to the invention maintain their strength, rigidity and fixed constant structural shape throughout all operating conditions of all their applications. Moreover, the metallic second phase is selected so that the grain structure thereof is and remains at least partially martensitic throughout the operating temperature range of the end use application for the structural part (e.g. a temperature range from −50° C. to +200° C.) so as to maintain the vibration damping characteristics as well as the strength.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A structural material having a high damping capacity and a high tensile strength, comprising:

a matrix comprising an essentially metallic matrix material selected from the group consisting of lightweight metals and lightweight metal alloys, and a metallic second phase in said matrix, wherein said metallic second phase comprises a metal alloy and has a grain structure that is at least partially martensitic, wherein said metal alloy comprises 48 to 52 atom % of nickel and 48 to 52 atom % of titanium relative to each other and further comprises at least one additive selected from the group consisting of zirconium, hafnium, copper, niobium, manganese, palladium, platinum and iron.

2. The structural material according to claim 1, wherein said metal alloy comprises 49.9 atom % of said nickel and 50.1 atom % of said titanium relative to each other.

3. The structural material according to claim 1, wherein said metallic second phase is in a form selected from the group consisting of granular particles, wires, short fibers, and layers.

4. The structural material according to claim 1, wherein said metallic second phase in total makes up 5 to 60 volume % of said structural material.

5. The structural material according to claim 1, wherein said lightweight metals are selected from the group consisting of aluminum and titanium, and said lightweight metal alloys are selected from the group consisting of aluminum alloys, titanium alloys, and magnesium alloys.

6. The structural material according to claim 1, wherein said matrix excludes iron.

7. The structural material according to claim 1, wherein said matrix material is an aluminum alloy comprising 0.40 to 0.8 wt. % of silicon, up to 0.7 wt. % of iron, 0.15 to 0.40 wt. % of copper, up to 0.15 wt. % of manganese, 0.8 to 1.2 wt. % of magnesium, 0.04 to 0.35 wt. % of chromium, up to 0.25 wt. % of zinc, up to 0.15 wt. % of titanium, up to 0.15 wt. % total of other additives, and the remainder of aluminum.

8. The structural material according to claim 1, wherein said grain structure of said metallic second phase is completely martensitic.

9. The structural material according to claim 1, wherein said metallic second phase maintains said grain structure being at least partially martensitic throughout an entire operating temperature range of said structural material.

10. The structural material according to claim 1, wherein said structural material having a high damping capacity and a high tensile strength further has an elongation of at least 10%.

11. A method of making the structural material according to claim 1, comprising the following steps:

a) providing a second phase material powder adapted to form said metallic second phase, and providing said matrix material;

b) mixing said second phase material powder with said matrix material to prepare a mixture; and c) consolidating said mixture to form said structural material.

12. The method according to claim 11, wherein said step of providing said matrix material comprises providing said matrix material in the form of a matrix material powder, said mixture is a powder mixture, and said step of consolidating said mixture comprises heat treating said mixture at a temperature in the range of 400 to 700° C. and pressing said mixture at a pressure in the range of 100 to 300 MPa.

13. The method according to claim 12, wherein said step of providing said matrix material powder comprises melting said matrix material and then atomizing said matrix material into an inert gas atmosphere.

14. The method according to claim 13, wherein said step of providing said second phase material powder comprises melting a second phase material and then atomizing said second phase material into an inert gas atmosphere.

15. The method according to claim 12, further comprising degassing said mixture before said step of consolidating said mixture.

16. The method according to claim 12, wherein said heat treating and said pressing comprise at least one of hot isostatic pressing, sintering, extrusion pressing and forging.

17. The method according to claim 11, wherein said step of providing said matrix material comprises providing said matrix material in molten liquid form, and said step of consolidating said mixture comprises solidifying said mixture.

18. The method according to claim 11, further comprising a step of coating powder particles of said second phase material powder with a coating material before said mixing step.

19. The method according to claim 11, wherein said second phase material powder comprises at least one of granular particles, wires, short fibers, and layers.

20. The method according to claim 11, further comprising a step of pre-treating said second phase material powder before said mixing step.

21. The method according to claim 20, wherein said pre-treating step comprises at least one of plastically deforming and homogenizing said second phase material.

22. A material having a high damping capacity and a high tensile strength, comprising:

a matrix comprising an essentially metallic matrix material; and a metallic second phase in said matrix;

wherein said metallic second phase has a grain structure that is at least partially martensitic; and wherein said matrix material comprises various different grain structures.

23. A material having a high damping capacity and a high tensile strength, comprising:

a matrix comprising an essentially metallic matrix material; and a metallic second phase in said matrix;

wherein said metallic second phase has a grain structure that is at least partially martensitic; and wherein said matrix is a composite matrix further comprising a reinforcing third phase dispersed in said essentially metallic matrix material.

24. material having a high damping capacity and a high tensile strength, comprising:

a matrix comprising an essentially metallic matrix material, and a metallic second phase in said matrix, wherein said metallic second phase has a grain structure that is at least partially martensitic, wherein said matrix per se has a matrix tensile strength, and wherein said high tensile strength of said material overall is at least 95% of said matrix tensile strength.

25. The structural material according to claim 24, wherein said high tensile strength is at least equal to said matrix tensile strength.

26. A material having a high damping capacity and a high tensile strength, comprising:

a matrix comprising an essentially metallic matrix material, and a metallic second phase in said matrix, wherein said metallic second phase has a grain structure that is at least partially martensitic, wherein said metallic second phase in total makes up greater than 30 vol. % of said material having a high damping capacity and a high tensile strength.

27. A structural material having a high damping capacity and a high tensile strength, comprising:

a matrix comprising an essentially metallic matrix material selected from the group consisting of lightweight metals and lightweight metal alloys, and a metallic second phase in said matrix, wherein said metallic second phase comprises a metal alloy and has a grain structure that is at least partially martensitic, wherein said metal alloy comprises at least two major alloying elements and a positive amount up to 25 atom % of at least one additive selected from the group consisting of zirconium, hafnium, copper, niobium, manganese, palladium, platinum, and iron.

28. The structural material according to claim 27, wherein said at least two major alloying elements are nickel and titanium.

29. The structural material according to claim 27, wherein said at least two major alloying elements comprise copper, zinc and aluminum.

30. The structural material according to claim 27, wherein said lightweight metals are selected from the group consisting of aluminum and titanium, and said lightweight metal alloys are selected from the group consisting of aluminum alloys, titanium alloys, and magnesium alloys, and wherein said matrix excludes iron.

31. The structural material according to claim 27, wherein said metallic second phase maintains said grain structure being at least partially martensitic throughout an entire operating temperature range of said structural material.

32. A structural material having a high damping capacity and a high tensile strength, comprising:

a matrix comprising an essentially metallic matrix material selected from the group consisting of lightweight metals and lightweight metal alloys, and a metallic second phase in said matrix, wherein said metallic second phase has a grain structure that is at least partially martensitic, and includes a core of a second phase material and an interfacial layer of a compound of said second phase material and said matrix material at an interface surface of said second phase adjoining said matrix material.

33. A structural material having a high damping capacity and a high tensile strength, comprising:

a matrix comprising an essentially metallic matrix material selected from the group consisting of lightweight metals and lightweight metal alloys, and a metallic second phase in said matrix, wherein said metallic second phase has a grain structure that is at least partially martensitic, wherein said structural material is a composite material, and wherein said second phase is in the form of discrete particles that are dispersed in said matrix and that are not homogeneously alloyed and not homogeneously mixed with said matrix material.

34. The structural material according to claim 33, wherein said metallic second phase comprises a metal alloy including 48 to 52 atom % of nickel and 48 to 52 atom % of titanium.

35. The structural material according to claim 33, wherein said metallic second phase comprises a metal alloy including copper, zinc and aluminum.

36. The structural material according to claim 33, wherein said lightweight metals are selected from the group consisting of aluminum and titanium, and said lightweight metal alloys are selected from the group consisting of aluminum alloys, titanium alloys, and magnesium alloys, and wherein said matrix excludes iron.

37. The structural material according to claim 33, wherein said metallic second phase maintains said grain structure being at least partially martensitic throughout an entire operating temperature range of said structural material.

38. A structural material having a high damping capacity and a high tensile strength, comprising:

a matrix comprising an essentially metallic matrix material selected from the group consisting of lightweight metals and lightweight metal alloys, and a metallic second phase in said matrix, wherein said metallic second phase has a grain structure that is at least partially martensitic, and wherein said second phase is in the form of particles that each respectively comprise a core of a core material and a coating layer of a coating material different from said core material provided on said core.

39. A rigid structural part having a constant rigid structural shape and size, and comprising a structural material that has a high damping capacity and a high tensile strength and that comprises:

a matrix comprising an essentially metallic matrix material selected from the group consisting of lightweight metals and lightweight metal alloys, and a metallic second phase in said matrix, wherein said metallic second phase has a grain structure that is at least partially martensitic.

40. The rigid structural part according to claim 39, wherein said metallic second phase comprises a metal alloy including 48 to 52 atom % of nickel and 48 to 52 atom % of titanium.

41. The rigid structural part according to claim 39, wherein said metallic second phase comprises a metal alloy including at least two major alloying elements and a positive amount up to 25 atom % of at least one additive selected from the group consisting of zirconium, hafnium, copper, niobium, manganese, palladium, platinum, and iron.

42. The rigid structural part according to claim 39, wherein said metallic second phase comprises a metal alloy including copper, zinc and aluminum.

43. The rigid structural part according to claim 39, wherein said lightweight metals are selected from the group consisting of aluminum and titanium, and said lightweight metal alloys are selected from the group consisting of aluminum alloys, titanium alloys, and magnesium alloys, and wherein said matrix excludes iron.

44. The rigid structural part according to claim 39, wherein said metallic second phase maintains said grain structure being at least partially martensitic throughout an entire operating temperature range of said rigid structural part.

* * * * *

UNITED STATES PATENT AND TRADEMARK OFFICE

CERTIFICATE OF CORRECTION

PATENT NO. : 6,346,132 B1
DATED : February 12, 2002
INVENTOR(S) : Huber et al.

It is certified that error appears in the above-identified patent and that said Letters Patent is hereby corrected as shown below:

Column 8,
Line 43, before "material", insert -- A --.

Signed and Sealed this

Twenty-third Day of April, 2002

*Attest:*

*Attesting Officer*

JAMES E. ROGAN
*Director of the United States Patent and Trademark Office*